US005397247A

United States Patent [19]

Aoki et al.

[11] Patent Number: 5,397,247

[45] Date of Patent: Mar. 14, 1995

[54] CONNECTOR CONSTRUCTION

[75] Inventors: Yoshihito Aoki; Yasuyoshi Serizawa; Satoru Unno, all of Shizuoka, Japan

[73] Assignee: Yazaki Corporation, Tokyo, Japan

[21] Appl. No.: 186,145

[22] Filed: Jan. 25, 1994

[30] Foreign Application Priority Data

Jan. 25, 1993 [JP] Japan ..... 5-027142

[51] Int. Cl.[6] ..... H01R 9/07

[52] U.S. Cl. ..... 439/496; 439/495

[58] Field of Search ..... 439/492–499, 439/633, 677–681

[56] References Cited

U.S. PATENT DOCUMENTS

| | | | |
|---|---|---|---|
| 3,017,602 | 1/1962 | Little | 439/496 |
| 3,114,587 | 12/1963 | Herrmann | 439/496 |
| 3,149,896 | 9/1964 | Hall | 439/495 |
| 3,159,447 | 12/1964 | Crimmins et al. | 439/496 |
| 3,325,769 | 6/1967 | Travis | 439/496 |
| 3,486,159 | 12/1969 | Mathews | 429/496 |

*Primary Examiner*—David L. Pirlot
*Attorney, Agent, or Firm*—Sughrue, Mion, Zinn, Macpeak & Seas

[57] ABSTRACT

A connector structure is provided wherein a generally sheet-like cable has a plurality of conductors disposed parallel to one another at predetermined intervals and is insulatively covered, and an end portion of the cable is inserted into an opening formed in a connector housing, so that the conductors are respectively pressed against and connected to a plurality of resilient connection terminals received in the housing. The structure includes a holder which is sandwiched by the pre-bent end portion of the cable, and having slits corresponding to gaps between the conductors; and a holder guide which is connected to the holder in such a manner that the holder and the cable pass through the holder guide. The holder and the holder guide are fitted into the housing, and the connector housing has partition walls engaging in the gaps and the slits.

6 Claims, 4 Drawing Sheets

CONNECTOR CONSTRUCTION

BACKGROUND OF THE INVENTION

This invention relates to a connector construction, and more particularly to a connector construction for connecting, for example, a flexible flat cable board (FFC) having a plurality of parallel disposed, flat-type conductors covered with an insulative resin.

Flexible flat cables, such as the above-mentioned flexible flat cable board (FFC) and a flexible printed circuit board (FPC) formed by printing an electrical conductor on an insulative film, have heretofore been extensively used in a wire harness, which interconnects electric parts in a body and a door of an automobile, and various kinds of equipments such as a computer, since the flat cable can be mounted in a narrow space because of its construction, and also can be provided on a moving part because of its flexible nature.

Such a flexible cable itself is flexible as described above, and therefore for connecting this cable to a connector, its end must be formed into a rigid terminal structure. In the prior art, for example, as shown in FIG. 4, an end portion of a cable 1 at which a conductor 2 is exposed is secured to a holder 3 in the form of a rigid plate, thereby providing a terminal structure. The cable 1 having this terminal structure is inserted, together with the holder 3, into a connector housing 4 from an opening 5 formed in a front side of the housing 4, and is press-contacted with a spring piece 6*a* of each resilient connection terminal 6 received in the connector housing 4, thereby making electrical connection.

One example of forming the end portion of the cable 1 into a terminal structure will now be described in further detail with reference to FIGS. 5 and 6. A plurality of fixing pins 3*a* formed on the surface of the flat plate-like holder 3 pass respectively through positioning mounting holes 1*a* which are formed through the cable 1 and disposed between conductors of the cable 1, thereby integrally joining the cable and the holder together. Alternatively, the cable 1 can be integrally joined to the holder 3 by an adhesive.

Such an integral construction is necessary for preventing the cable 1, connected to the connector, from being withdrawn from the housing by a pulling load acting on the cable 1 in a direction of an arrow.

Problems to be solved by the Invention

However, since the above integral construction is obtained by engaging the plurality of fixing pins respectively in the mounting holes, or by adhesive bonding, the above construction has not been satisfactory because of a poor efficiency of an assembling operation and the production cost.

Furthermore, in the above construction, water droplets, resulting from condensation, flow between the adjoining conductors (see arrow H in FIG. 6) to a conductor-exposed portion 1*b*, thereby producing a leakage current, which may results in a possibility that an electrical connection performance is degraded.

SUMMARY OF THE INVENTION

The present invention has been made in view of the foregoing, and an object of the invention is to provide a connector construction in which an end portion of a flexible flat cable (hereinafter referred to as "cable") is formed into a terminal structure so as to be connected to a connector, and the production of leakage current between conductors is prevented.

The above object has been achieved by a connector construction wherein a generally sheet-like cable has a plurality of conductors disposed parallel to one another at predetermined intervals, and is insulatively covered; and an end portion of the cable is inserted into an opening formed in a connector housing, so that the conductors are respectively pressed against and connected to a plurality of resilient connection terminals received in the housing; CHARACTERIZED by the provision of a holder which is sandwiched by the pre-bent end portion of the cable, and has slits corresponding to gaps between the conductors; a holder guide which is integrally connected to the holder in such a manner that the holder and the cable pass through the holder guide; and the connector housing into which the holder and the holder guide are fitted, the connector housing having partition walls engaged in the gaps and the slits.

The holder and the holder guide support the cable in the bent condition, and hold the cable therebetween. Therefore, an external force acting on the cable in a withdrawing direction can be dealt with, and a rearward withdrawal of the cable can be suitably prevented. The connector housing has terminal receiving chambers, and the partition walls which are engaged in the slits in the holder to interrupt the flow of water droplets between the terminals. Therefore, leakage current is prevented from being produced, and the partition walls prevent the deformation of a rectangular upper wall of the housing due to an internal pressure from the resilient connection terminals, thereby ensuring a stable connection performance.

DESCRIPTION OF PREFERRED EMBODIMENTS

A preferred embodiment of the present invention will now be described with reference to the drawings.

Figure 1:
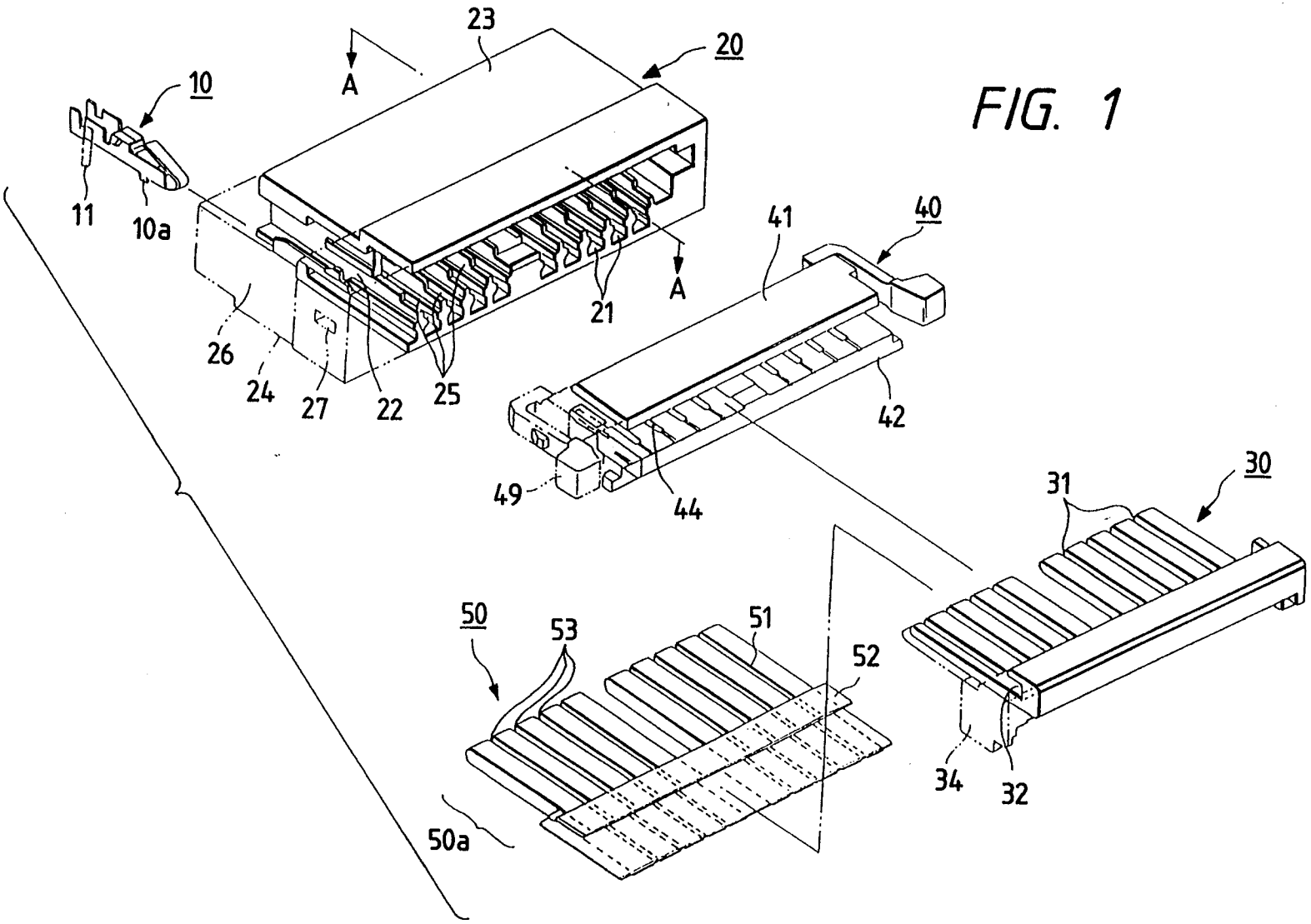
FIG. 1 is an exploded perspective view of one preferred embodiment of a connector of the present invention.

The connector construction of the present invention comprises a connector housing 20 into which a plurality of resilient connection terminals 10 (only one of which is shown in FIG. 1) are inserted in a retained manner, and a holder 30 and a holder guide 40 which hold a cable 50 (later described), and are inserted into the housing 20 from an opening 21 formed in a front face of this housing 20.

The housing 20 is molded of an insulative resin, and has a generally rectangular shape, and has terminal receiving chambers 22 for respectively receiving the plurality of resilient connection terminals 10 inserted from a rear side of the housing. Namely, the space within the housing is divided into a plurality of chambers by partition walls 25 interconnecting an upper wall 23 and a lower wall 24 of the housing 20. The partition walls 25 extend to the opening 21.

The resilient connection terminal 10 has a construction similar to that of a conventional terminal, and a low-voltage wire 11 connected to other device is press-connected to this terminal 10. When the terminal 10 is inserted into the housing 20, its retaining portion 10*a* is engaged with a retaining step portion (not shown), provided within the terminal receiving chamber 22, so that the terminal 10 is retained in the housing 20.

In this embodiment, a flexible flat cable is used as the cable 50 to be held by the holder 30 and the holder guide 40. In this cable 50, a plurality of flat-type conductors 51, arranged parallel to one another at predetermined intervals, are covered with an insulative resin 52 at their opposite sides. A cable end portion 50*a* to be connected to the resilient connection terminals 10 is beforehand bent, and the insulative resin 52 is removed from this bent portion, so that a gap 53 is formed between any two adjacent conductors.

Figure 2:
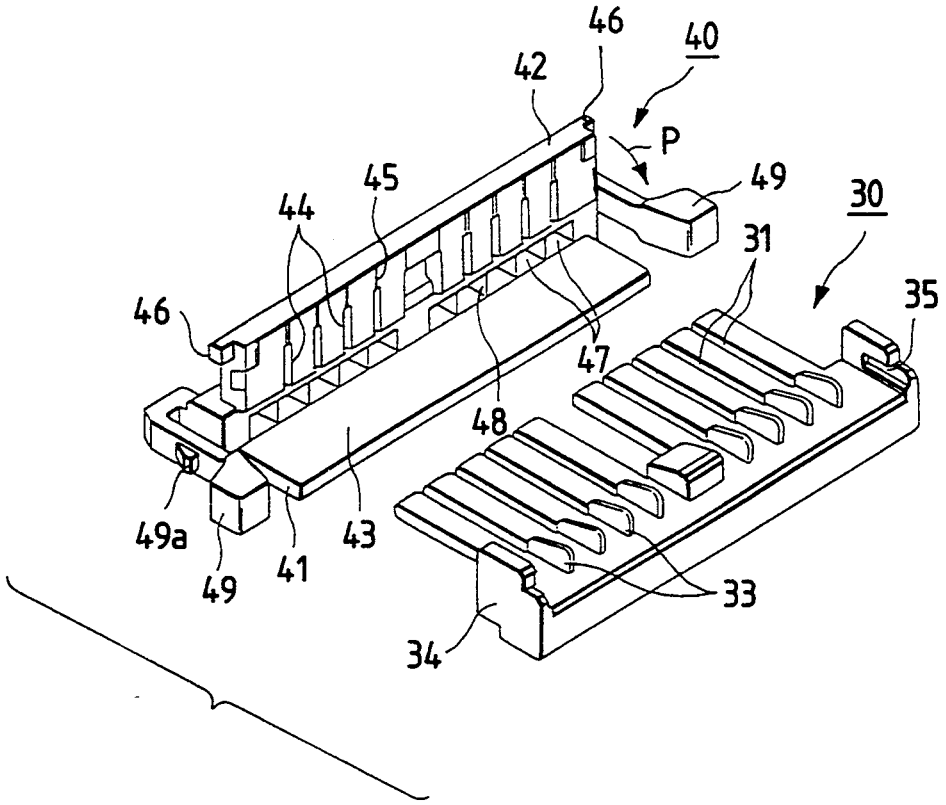
FIG. 2 is a perspective view showing a holder and a holder guide of FIG. 1 from a reverse side.

The holder 30 is of a generally comb-shape having slits 31 generally corresponding in configuration to the gaps 53 between the conductors of the cable 50. A rear end portion defining a proximal end portion of the comb is folded back over the upper surface of the holder to provide a terminal receiving portion 32. As shown in FIG. 2, positioning ribs 33 for positioning the cable 50 are formed respectively on those portions of the reverse side of the holder immediately adjacent respectively to the proximal ends of the slits 31. Fixing recesses 35 for retaining a rotatable member 42 (described later) of the holder guide 40 in a closed condition are formed respectively in upstanding opposite side walls 34 of the holder 30.

Small projections may be formed respectively on the distal end portions of the comb teeth of the holder 30 whereas retaining holes corresponding to these small projections may be formed respectively in the bent portions of the conductors 51 of the cable 50. In this case, when the cable 50 is held by the holder 30, the small projections are engaged respectively in the retaining holes, thereby preventing the conductors 51 for being displaced laterally.

The holder guide 40 includes a body 41 to be inserted into the housing 20 from the opening 21, and the rotatable member 42 pivotally mounted on a rear end of the body 41 for rotation relative to this body 41. This rotatable member 42 in its closed condition can be partially inserted into the housing 20.

The rotatable member 42 forms, in a region of rotation thereof, a holder holding portion 43 for holding the holder 30, and has at its inner surface grooves 44 for respectively receiving the positioning ribs 33 of the holder 30, and projections 45 which extend respectively from the grooves 44, and can be press-fitted respectively in the gaps between the conductors of the cable 50. Fixing projections 46, which are engageable respectively in the fixing recesses 35 of the holder 30 in the closed condition of the rotatable member 42, are formed at opposite ends of the rotatable member 42, respectively.

On the other hand, fixing insertion portions 47 are formed in the body 41, and the comb tooth portions of the holder 30 pass respectively through the fixing insertion portions 47 in such a manner that these comb tooth portions are sandwiched by the pre-bent cable end portion 50*a*. Namely, the fixing insertion portions 47 are separated from one another by partition walls 48 which are engaged respectively in the slits 31 of the holder 30 when the holder 30 is inserted for integral connection. Lock pieces 49 are mounted respectively on the opposite ends of the body 41 in a cantilever manner, with their free ends directed rearwardly. When the holder guide 40 is inserted, together with the holder 30, into the housing 20, retaining projections 49*a*, formed respectively on the lock pieces 49, are engaged respectively in engagement holes 27 formed respectively in side walls 26 of the housing 20.

The manner of holding the cable 50 by the holder 30 of the above construction, as well as the manner in which after the holder 30 holding the cable 50 is integrally connected to the holder guide 40, they are inserted into the housing 20, will now be described in this order.

First, as shown in FIG. 1, the cable end portions 50*a* of the cable 50 having the exposed conductors 51 is provided in a pre-bent condition. The holder 30 is joined to the cable, with the comb tooth portions of the holder inserted into the pre-bent cable end portion 50*a*, so that the comb tooth portions are sandwiched by the cable end portion 50*a*. In this condition, the positioning ribs 33 of the holder 30 are received respectively in the gaps 53 formed in the cable end portion 50*a*, thereby holding the cable 50 in a predetermined position, and at the same time the slits 31 in the holder 30 are respectively disposed in registration with the gaps 53 in the cable end portion 50*a* of the cable 50. A distal end portion of the bent cable 50 is received in the terminal receiving portion 32 of the holder 30.

The holder 30, having the cable 50 thus provisionally retained thereto, is then integrally connected to the holder guide 40. More specifically, the rotatable member 42 of the holder guide 40 is held in an upstanding, open position, and in this condition the holder 30 is positioned in the holder holding portion 43 in such a manner that the comb tooth portions of the holder 30 pass through the fixing insertion portions 47, respectively. At this time, the partition walls 48 separating the fixing insertion portions 47 are received in the slits 31 of the holder 30, respectively. The comb tooth portions of the holder 30 pass through the fixing insertion portions 47, and are exposed on the front side of the holder guide 40. Thereafter, the rotatable member 42 is rotated forwardly, as indicated by arrow P in FIG. 2, to cause the fixing projections 46 to engage in the fixing recesses 35, respectively, so that the rotatable member 42 is held in the closed condition. In the closed condition of the rotatable member 42, the holder guide 40 integrally holds the holder 30, and the cable 50 is intimately held between the holder guide 40 and the holder 30. The rotatable member 42 is urged against the holder surface, with the projections 45 disposed between the conductors of the cable 50. Since the projections 45 are disposed between the conductors of the cable 50, they interrupt the flow of water droplets into the connector through the gaps between the conductors.

Figure 3:
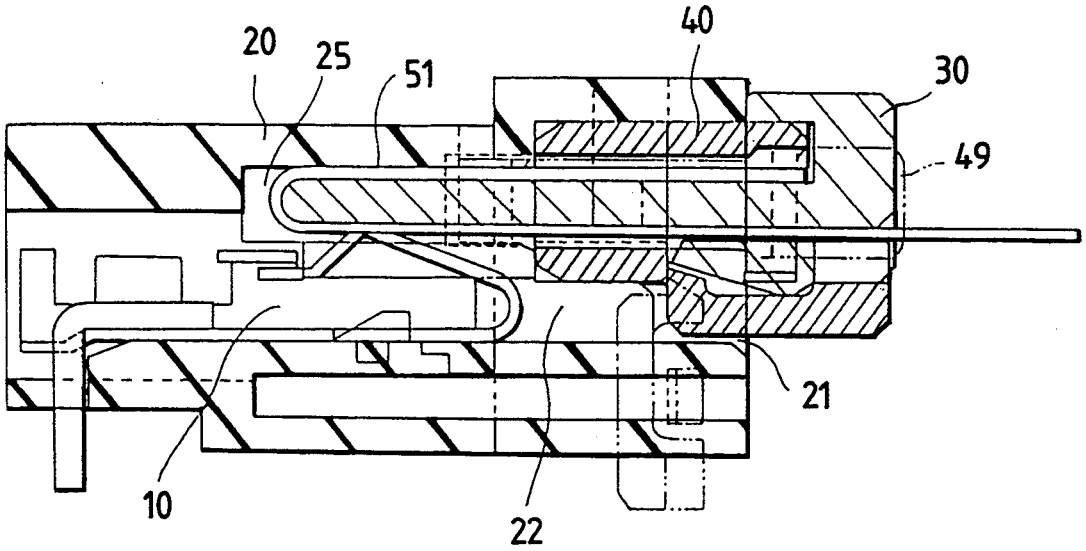
FIG. 3 is a cross-sectional view taken along the line A—A of FIG. 1, showing a connected condition of the connector.
Figure 4:
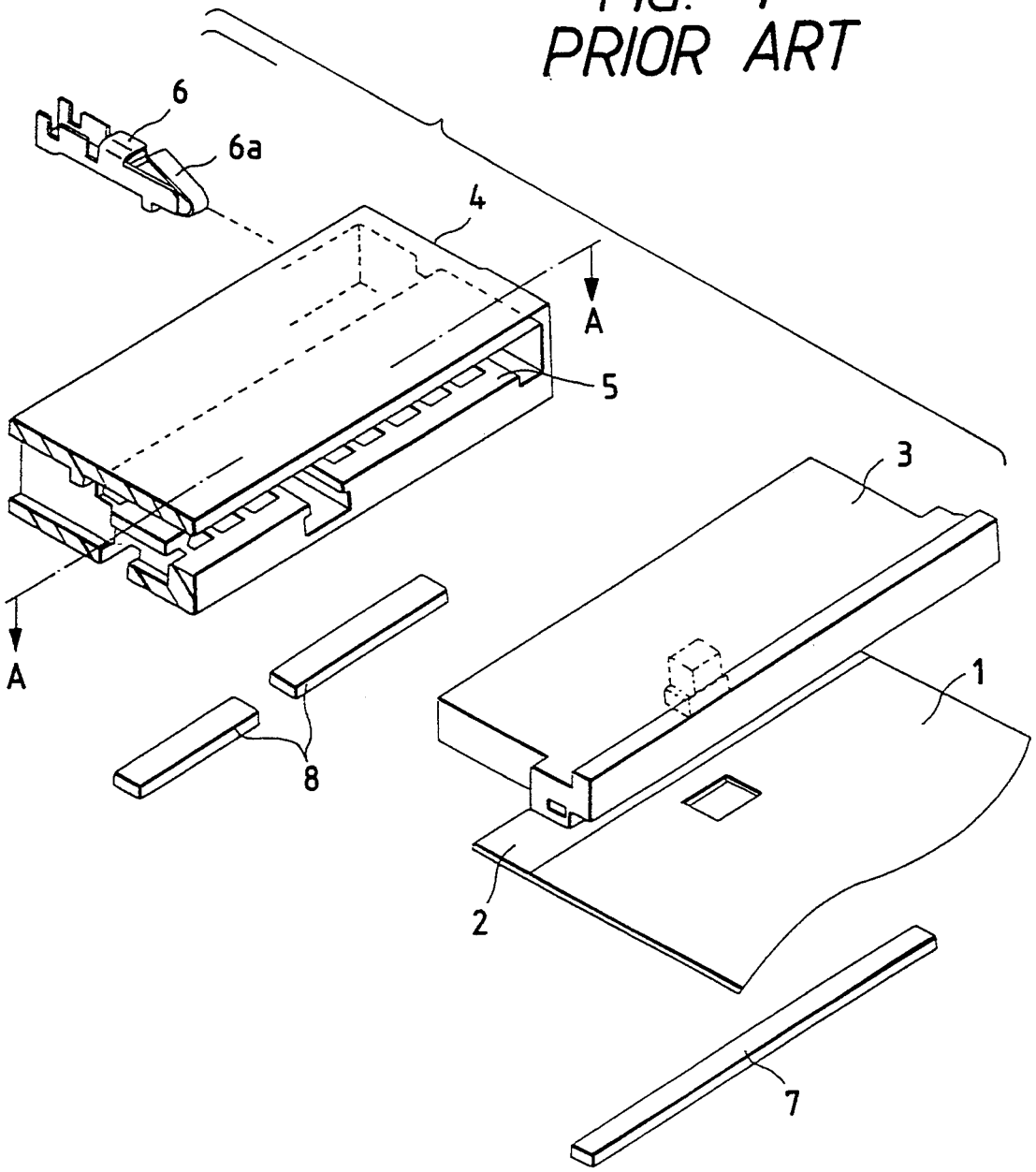
FIG. 4 PRIOR ART
FIG. 4 is an exploded perspective view of a conventional example.
Figure 5:
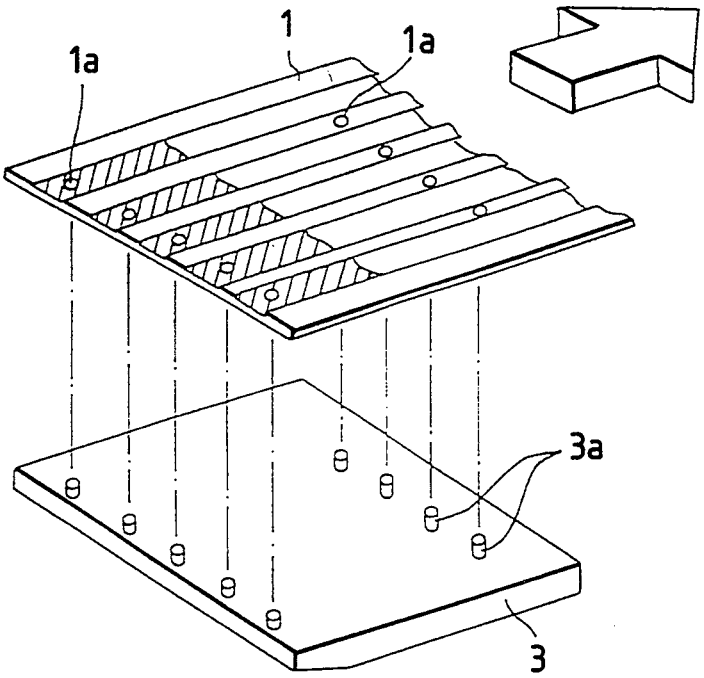
FIG. 5 PRIOR ART
FIG. 5 is a perspective view explanatory of a condition of connection between a cable and a holder.
Figure 6:
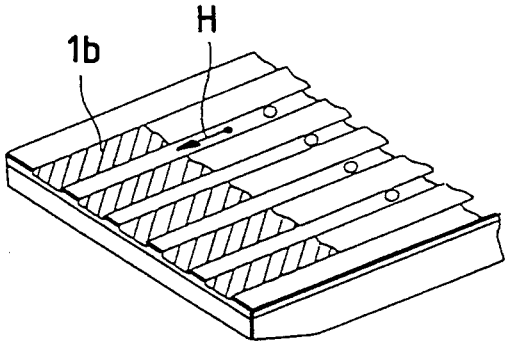
FIG. 6 PRIOR ART
FIG. 6 is a cross-sectional view showing the connected condition of FIG. 5.

The rotatable member 42 of the holder guide 40 may be replaced by a non-rotatable member of a recumbent U-shaped cross-section, in which case the holder guide can still be combined with the holder 30. Also, the grooves 44 shown in FIG. 2 may be extended to the end of the rotatable member 42. In this case, although the projections 45 are omitted, the conductors 51 of the cable 50 are isolated from one another by the partition walls 25 of the housing 20, and therefore leakage current due to water droplets is prevented. The holder guide 40 integrally connected to the holder 30 is then inserted into the housing 20 from the opening 21, as shown in FIG. 3. At this time, the conductors 51 exposed from the holder guide 40 are inserted into the terminal receiving chambers 22 of the housing 20 in such a manner that the partition walls 25 of the housing 20 are received in the gaps 53 between the conductors and also in the slits 31 of the holder 30. As a result, the conductors 51 exposed at the cable end portion 50*a* are pressed respectively against the resilient connection terminals 10 within the housing 20, thereby making electrical connection. When the holder guide 40 is inserted into the housing 20, the lock pieces 49 are elastically deformed to cause the retaining projections 49*a* to engage in the engagement holes 27 of the housing 20, so that the holder guide is connected to the housing 20 against disengagement therefrom.

As described above, in the connector construction of the present invention, the cable is caused to have the terminal structure, and is held in the bent condition by the holder and the holder guide, and also the cable is held between the holder and the holder guide. Therefore, an external force acting on the cable in a withdrawing direction can be sufficiently dealt with. Thanks to the provision of the slits, the holder is integrally connected to the holder guide in a manner to separate the conductors from one another, and is inserted into the terminal receiving chambers of the housing. Therefore, the flow of water droplets between the conductors is prevented, thereby preventing leakage.

What is claimed is:

1. A connector structure wherein a generally sheet-like cable has a plurality of conductors disposed parallel to one another at predetermined intervals and is insulatively covered, and an end portion of said cable is inserted into an opening formed in a connector housing, so that said conductors are respectively pressed against and connected to a plurality of resilient connection terminals received in said housing, said structure comprising:

a holder which is sandwiched by a pre-bent end portion of said cable, and having slits corresponding to gaps between said conductors; and a holder guide which is connected to said holder in such a manner that said holder and said cable pass through said holder guide;

wherein said holder and said holder guide are fitted into said housing, and said connector housing has partition walls engaging in said gaps and said slits.

2. A connector system for connecting at least one terminal to a generally sheet-like cable having a plurality of insulatively covered conductors disposed parallel to one another at predetermined intervals to define therebetween gaps, comprising:

a connector housing having at least one partition wall;

a holder which is sandwiched by a pre-bent exposed end portion of said cable and has slits corresponding to said gaps defined between said conductors; and a holder guide which is connected to said holder so that said holder and said cable pass through said holder guide, wherein said holder and said holder guide are fitted in said housing, and said partition wall is alignment with said gaps and said slits.

3. The system according to claim 2, wherein said holder includes a plurality of positioning ribs for positioning conductors of said cable in place.

4. The system according to claim 2, wherein said holder includes a terminal receiving portion for receiving therein a distal end portion of said cable for provisional retention of said cable.

5. The system according to claim 1, wherein said holder guide includes a body and a rotatable member having a plurality of projections corresponding to said conductors of said cable for pressing said cable.

6. The system according to claim 5, further including an elastic engagement means for engaging said holder guide with said connector housing for pressing said projections against said cable.

* * * * *